US005829450A

United States Patent [19]

Hicaro, Jr. et al.

[11] Patent Number: 5,829,450

[45] Date of Patent: Nov. 3, 1998

[54] DEVICE TO CONTROL SMOKE DISSIPATION BY CIGARETTES

[75] Inventors: Enrique Hicaro, Jr.; David A. Sherman, both of Chicago, Ill.

[73] Assignee: Perfect World Technologies, L.L.C., Chicago, Ill.

[21] Appl. No.: 826,384

[22] Filed: Apr. 9, 1997

[51] Int. Cl.[6] ..... A24F 13/18

[52] U.S. Cl. ..... 131/235.1; 131/256

[58] Field of Search ..... 131/235.1, 256, 131/241, 240, 237, 220; D27/9; 232/43.1

[56] References Cited

U.S. PATENT DOCUMENTS

| | | | |
|---|---|---|---|
| 1,874,319 | 8/1932 | Lill | 131/235 R |
| 2,268,149 | 12/1941 | Hinkle | 131/235 R |
| 2,340,618 | 2/1944 | Schiszler | 131/235 R |
| 2,348,423 | 5/1944 | Schylander | 131/235 R |
| 2,595,103 | 4/1952 | Schmaling, Sr. | 131/235 R |
| 2,625,163 | 1/1953 | Jones et al. | 131/235 R |
| 2,883,992 | 4/1959 | Hastings | 131/235 R |
| 2,894,514 | 7/1959 | Moore | 131/235 R |
| 2,965,108 | 12/1960 | Schlatterer | 131/235 |
| 3,165,105 | 1/1965 | Campbell | 131/235 |
| 3,386,452 | 6/1968 | Davis | 131/235 |
| 3,468,317 | 9/1969 | Rowland | 131/255 |
| 3,486,509 | 12/1969 | Menola | 131/235 R |
| 4,108,153 | 8/1978 | Pearson | 131/235 R |
| 4,236,539 | 12/1980 | Mosby, Jr. | 131/235 |
| 4,354,510 | 10/1982 | Eakin | 131/235 R |
| 4,423,743 | 1/1984 | Spielvogel | 131/235 |
| 4,497,329 | 2/1985 | O'Dell | 131/235 X |
| 4,516,587 | 5/1985 | Eastridge et al. | 131/235.1 |
| 4,572,217 | 2/1986 | Newman, Sr. et al. | 131/235 |
| 4,726,513 | 2/1988 | Wolfe | 232/43.1 |
| 4,886,076 | 12/1989 | Gilbert et al. | 131/235 |
| 4,920,988 | 5/1990 | Cancellara | 131/235 |
| 4,982,746 | 1/1991 | Pruyne | 131/235 |
| 5,020,549 | 6/1991 | Wojcik | 131/235 |
| 5,085,230 | 2/1992 | Roman | 131/235 R |
| 5,287,862 | 2/1994 | Pruyne | 131/235 |
| 5,361,785 | 11/1994 | Wu | 131/235 |

FOREIGN PATENT DOCUMENTS

| | | | |
|---|---|---|---|
| 0413685B1 | 11/1994 | European Pat. Off. | 131/270 |
| 2310715 | 12/1976 | France | 131/270 |
| 2060349 | 5/1981 | United Kingdom | 131/270 |
| 2193876 | 2/1988 | United Kingdom | 131/270 |
| 2212381 | 7/1989 | United Kingdom | 131/270 |

*Primary Examiner*—Kimberly L. Asher
*Assistant Examiner*—Charles W. Anderson
*Attorney, Agent, or Firm*—Banner & Witcoff, Ltd.

[57] ABSTRACT

An ashtray includes an insert with a cylindrical section having at least one radial or side opening therethrough and lugs at one end to restrict the movement of a cigarette. An entry to the cylindrical section is provided. The side opening is sized to fit over a burning portion of a lighted cigarette to diminish the rate of combustion and simultaneously suppress smoke while permitting the cigarette to continue to burn for more than a few seconds, but causing extinguishment after a defined period greater than a few seconds. The holder may be used in combination with a table top ashtray, a cup holder ashtray or various other ashtrays.

25 Claims, 7 Drawing Sheets

DEVICE TO CONTROL SMOKE DISSIPATION BY CIGARETTES

BACKGROUND OF THE INVENTION

This invention relates to a cigarette holder device which is designed to control the rate of burning of a lighted cigarette and thereby reduce the amount of smoke which results from the combustion of the cigarette positioned within the device.

Various devices have been proposed for controlling the emanation of smoke from a cigarette, particularly when the cigarette is retained within an ashtray or similar receptacle. Roman, in U.S. Pat. No. 5,085,230 issued Feb. 4, 1992, entitled Smoker's Appliance, discloses a device which controls the amount of smoke emanating from a cigarette or similar product by means of a specially constructed tubular member which appears to constitute a heat sink and also appears to control the amount of oxygen available for combustion of the cigarette. U.S. Pat. No. 5,085,230 is incorporated herewith by reference. U.S. Pat. No. 5,085,230 discloses numerous prior art patents depicting similar devices. Included among the various references which appear to be generally relevant to this subject matter are the following:

- U.S. Pat. No. 1,874,319, Lill, issued Aug. 30, 1932—Ash Tray
- U.S. Pat. No. 2,268,149, Hinkle, issued Dec. 30, 1941—Combination Ash Receptacle and Flexible Cover
- U.S. Pat. No. 2,340,618, Schiszler, issued Feb. 1, 1944—Cigarette Receptacle
- U.S. Pat. No. 2,348,423, Schylander, issued May 9, 1944—Ash Tray and Plate Securing Means Therefor
- U.S. Pat. No. 2,595,103, Schmaling, Sr., issued Apr. 29, 1952—Cigarette Ash Receiver
- U.S. Pat. No. 2,625,163, Jones et al., issued Jan. 13, 1953—Safety Cigarette Holder
- U.S. Pat. No. 2,883,992, Hastings, issued Apr. 28, 1959—Combination Ashtray and Lighted Cigarette Support
- U.S. Pat. No. 2,965,108, Schlatterer, issued Dec. 20, 1960—Cigarette Extinguisher
- U.S. Pat. No. 2,894,514, Moore, issued Jul. 14, 1959—Smoker's Set
- U.S. Pat. No. 3,165,105, Campbell, issued Jan. 12, 1965—Ash-Retaining Safety Cigarette
- U.S. Pat. No. 3,386,452, Davis, issued Jun. 4, 1968—Cigarette Extinguisher
- U.S. Pat. No. 3,468,317, Rowland, issued Sep. 23, 1969—Collapsible and Stackable Paper Ash Receptacle for Cigarettes
- U.S. Pat. No. 4,236,539, Mosby, Jr., issued Dec. 2, 1980—Smoking Apparatus
- U.S. Pat. No. 4,354,510, Eskin, issued Oct. 19, 1982—Cigarette Snuffer
- U.S. Pat. No. 4,423,743, Spielvogel, issued Jan. 3, 1984—Gravity Held Ashtray Apparatus
- U.S. Pat. No. 4,497,329, O'Dell, issued Feb. 5, 1985—Cigarette Snuffer
- U.S. Pat. No. 4,572,217, Newman, Sr. et al., issued Feb. 25, 1986—Fire-Safe Cigarette Holder System
- U.S. Pat. No. 4,886,076, Gilbert et al., issued Dec. 12, 1989—Cigarette Snuffer
- U.S. Pat. No. 4,920,988, Cancellara, issued May 1, 1990—Safety Ashtray

- U.S. Pat. No. 4,982,746, Pruyne, issued Jan. 8, 1991—Device for Slowing the Burning of Resting Cigarette and for Extinguishing A Cigarette
- U.S. Pat. No. 5,020,549, Wojcik, issued Jun. 4, 1991—Smokeless Ashtray with Controlled Combustion Chambers
- U.S. Pat. No. 5,287,862, Pruyne, issued Feb. 22, 1994—Device for Slowing the Burning of A Resting Cigarette
- U.S. Pat. No. 5,361,785, Wu, issued Nov. 8, 1994—Ash Tray While the devices disclosed in the identified patents, including Roman, U.S. Pat. No. 5,085,230, appear to be quite useful, there has remained a need to provide a device which has an improved construction for controlling the rate of burn of smoking materials such as cigarettes, and which is useful in various environments. In other words, there has remained a need for a smoke control and dissipation device useful in combination with various types of ashtrays and cigarette holders. Further, development of a product with an improved ability to control the burn rate of cigarettes to thereby decrease smoke emanating from a cigarette; to increase the life of a cigarette while it is in an ashtray and not being smoked; and to provide for self-extinguishment of a cigarette or other smoking materials when placed in an ashtray for an extended period of time is desirable.

SUMMARY OF THE INVENTION

Briefly, the present invention comprises a cigarette holder useful for controlling the burn rate of a lighted cigarette or other smoking material. The holder includes a holder body which has a generally cylindrical shaped passage extending entirely through a cigarette support member. The cylindrical passage includes one or more radial slots or openings through the support member which are typically spaced about the periphery of the cylindrical passage. Lugs are positioned at the end of the cylindrical passage to engage and hold the unburned portion of the cigarette or smoking material in position so that it will not pass entirely through the passage. The burned ash may extend beyond the support lugs. At the outside end of the passage an opening in the holder body leads into the cylindrical passage to assist in guiding the lighted cigarette or smoking material into the passage. In a preferred embodiment, the opening in the holder body is cylindrical of funnel shaped. In one preferred embodiment no opening is provided at the top or zenith of the passage and the passage is oriented at an acute angle with respect to a horizontal surface. The holder may be formed solely of a molded plastic material, or in a preferred embodiment the cylindrical passage may be defined by a shaped metal sleeve retained in a molded plastic holder body. Such a sleeve will typically have a diameter substantially equal to the outside diameter of a cigarette and will include locking tabs to hold the sleeve in the holder body.

The holder in one preferred embodiment includes side and the lower edge sections or flanges surrounding the support member which are adapted to fit into a compatible opening defined in an ashtray. In this manner, ashtrays of various size, construction and configuration may be utilized in combination with the holder. For example, an ashtray with an internal rim within a dish may be utilized to receive a holder into an opening in the internal rim. Alternatively the holder may be used in combination with an ashtray having a peripheral rim wherein the rim is designed to retain the ashtray in the cup holder of an automobile for example. Additionally, the holder may be used in combination with a support arm configured to engage and support the holder in an ashtray in a vehicle, for example.

Thus it is an object of the invention to provide an improved cigarette holder for controlling the burn rate of a lighted cigarette or other smoking material.

It is a further object of the invention to provide an improved, universal cigarette holder which may be used in combination with various types, shapes and configurations of cigarette or smoking material ashtrays.

Another object of the invention is to provide a cigarette holder which has a construction which includes peripheral openings extending from a cylindrical passage for the cigarette wherein the openings are spaced about the periphery of the cylindrical section.

Yet a further object of the invention is to provide an improved cigarette or smoking material holder which is easy to utilize and which rigorously controls the burn rate of a cigarette or other smoking material retained within the holder.

Yet a further object of the invention is to provide a cigarette holder which includes a cylindrical passage or opening having lugs projecting at the inner end of the opening to retain the cigarette or smoking material thereby preventing it from passing entirely through the passage. another object of the invention is to provide a cigarette holder which substantially totally suppresses slip or side stream smoke emanating from a burning cigarette whenever the cigarette is positioned in the holder.

These and other objects, advantages and features of the invention will be set forth in a detailed description which follows.

BRIEF DESCRIPTION OF THE DRAWING

In the detailed description which follows, reference will be made to the following figures.

DESCRIPTION OF THE PREFERRED EMBODIMENTS

Figure 1:
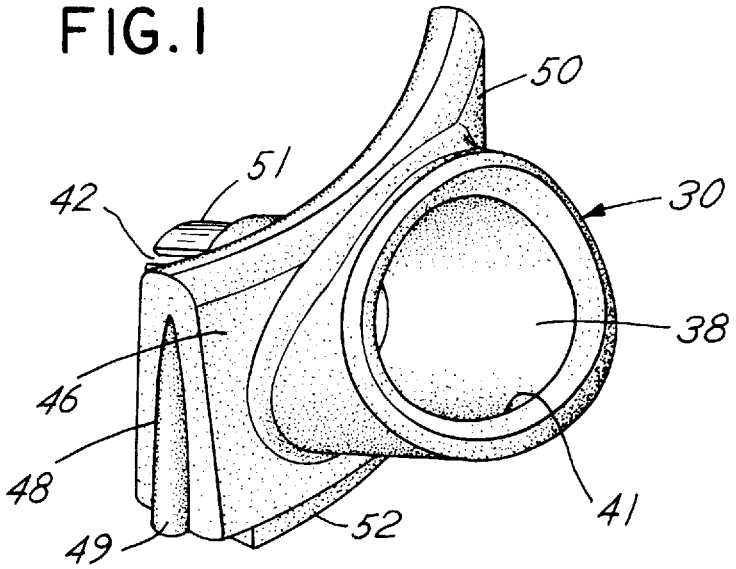
FIG. 1 is a perspective view of a cigarette holder incorporating the invention.

In the following description, like numbers will refer to like components or component parts of the various embodiments. FIGS. 1–6 disclose a cigarette holder which is an embodiment of the invention that may be used in combination with various ashtrays. Thus, by way of example and not limitation, the holder of FIGS. 1–6 may be used in combination with a table top ashtray in a manner illustrated by FIGS. 7 through 11. Further the holder of FIGS. 1 through 6 may be used in combination with a cup holder type ashtray as illustrated in FIGS. 12 through 15. Finally, the holder of FIGS. 1–6 may be used in combination with a device that will support the holder in combination with another ashtray such as an automobile ashtray. This is illustrated in FIGS. 16 through 20. The holder of FIGS. 1–6 is thus a universal element for use with ashtrays of various size, shape and purpose. The following description will therefore be directed to separate embodiments of the invention in the combinations referenced as well as the separate, universal holder of FIGS. 1 through 6. However, other holders may incorporate the invention, and the invention may be integrally included in various ashtray designs.

UNIVERSAL CIGARETTE HOLDER

As depicted in FIGS. 1–6, a holder 30 includes a generally cylindrical holder body or section 32 which has an inner end 34 and an outer end 36. The outer end 36 forms a uniform, smooth transition into a funnel-shaped opening section 38. The holder body or cylindrical section 32 includes a cylindrical passage 39 with a center line axis 40. A series of radially outwardly extending, longitudinal slots, such as slots 42, extend through the sides of the passage 39 of cylindrical section 32 from the inside thereof through the outside. In the preferred embodiment the slots 42 are parallel to axis 40. One or more slots 42 may be utilized. The slots 42 extend from the inner end 34 of passage 39, at least in a preferred embodiment, for about 60% of the length of the passage 39 between ends 34 and 36. Incorporated at the inner end 34 are one or more inwardly extending tabs or lugs 44 which project radially inward toward the center line axis 40.

The funnel section 38 has an opening 41 with a generally elliptical cross section pattern for those cross sections which are perpendicular to axis 40. However, any funnel-shaped configuration which tends to guide a lighted cigarette through the funnel section 38 into the cylindrical section 32 may be utilized. Note that the diameter of the cylindrical section 32 is substantially equal to or slightly greater than that of a typical cigarette. Further note that the lugs such as lugs 44 extend inwardly a sufficient distance to prevent a cigarette from passing entirely through the cylindrical section 32 by engaging the unburned paper holding the tobacco of the cigarette. In this manner, the lighted portion of the cigarette or other burning material or ash may extend beyond the lugs 44 while at the same time movement of the cigarette is controlled to the extent that the lugs 44 hold the cigarette, and the combustion rate thereof is controlled due to the limited access of air or oxygen through the slots 42 to the cigarette or other uncombusted material.

In a preferred embodiment, the holder 30 further includes a partially circumferential, shaped support flange 46 extending laterally from the sides of the cylindrical section 32 and the funnel-shaped section 38. The laterally extending support section or flange 46 includes a first and second opposed side edges 48 and 50 as well as a bottom edge 52. The edges 48, 50 and 52 substantially surround the cylindrical section 32. The side edges 48 and 50 include projecting, shaped ribs 49 which facilitate guidance of the holder 30 into combination with other ashtrays as depicted and described in the later figures of the specification. It is noted that the sides 48 and 50 are generally parallel or flared outward slightly bottom edge 52 and are spaced from one another on opposite sides of the cylindrical section 32 and funnel section 38. It is further noted that the flange 46 is generally arcuate so as to smoothly blend into the rim of the various ashtray devices as depicted in the remaining figures. The bottom edge 52 comprises a projecting tab which fits into a compatible slot defined in the ashtray devices as discussed below.

The flange 46 also provides a means for orienting the passage 39 relative to the holder 30 or ashtray in which the holder 30 is positioned; that is, typically a cigarette is positioned in an ashtray so as to define an acute angle with respect to a horizontal surface. The flange 46 is thus angled with respect to the axis 40 to define the acute angle which axis 40 of passage 39 forms with a horizontal plane.

Figure 4:
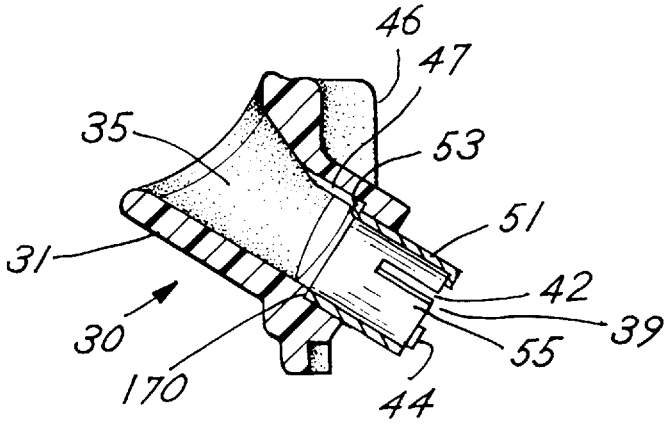
FIG. 4 is a cross sectional view of the holder of FIG. 2.
Figure 5:
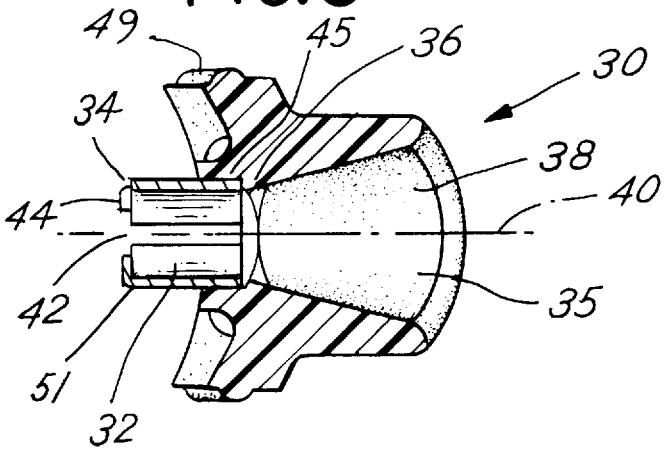
FIG. 5 is a cross sectional view of the holder of FIG. 3 taken along the line 5—5.
Figure 6:
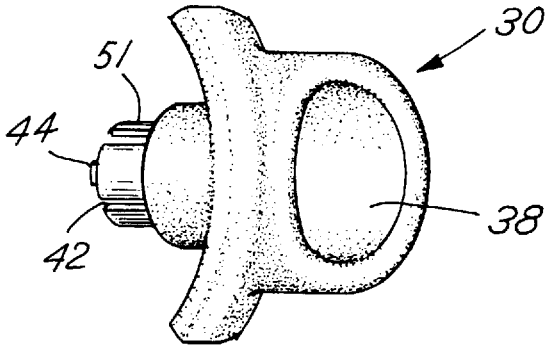
FIG. 6 is a top plan view of the holder of FIG. 1.
Figure 7:
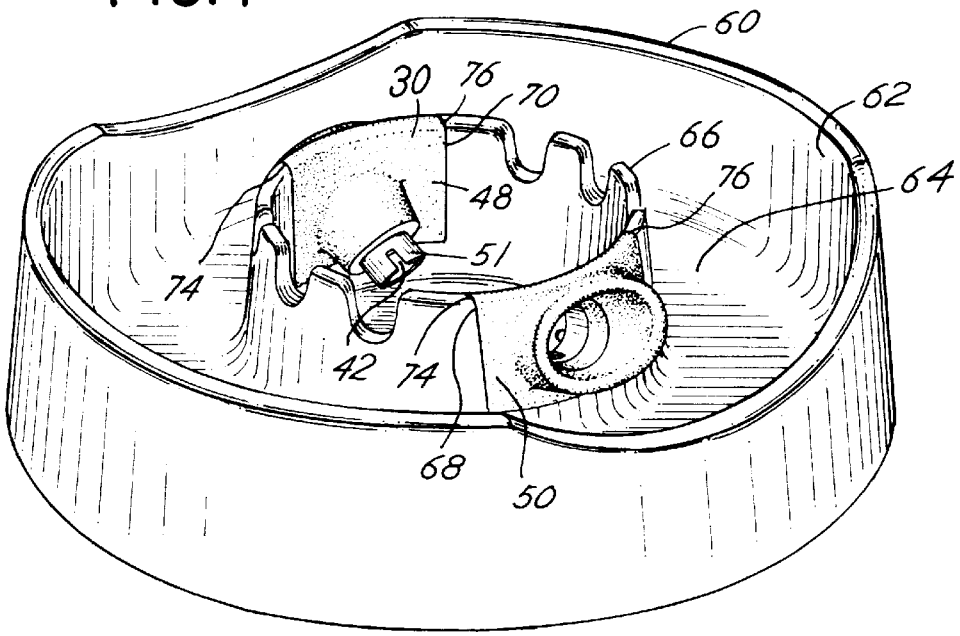
FIG. 7 is a perspective view of the holder of FIG. 1 in combination with a table top ashtray.
Figure 8:
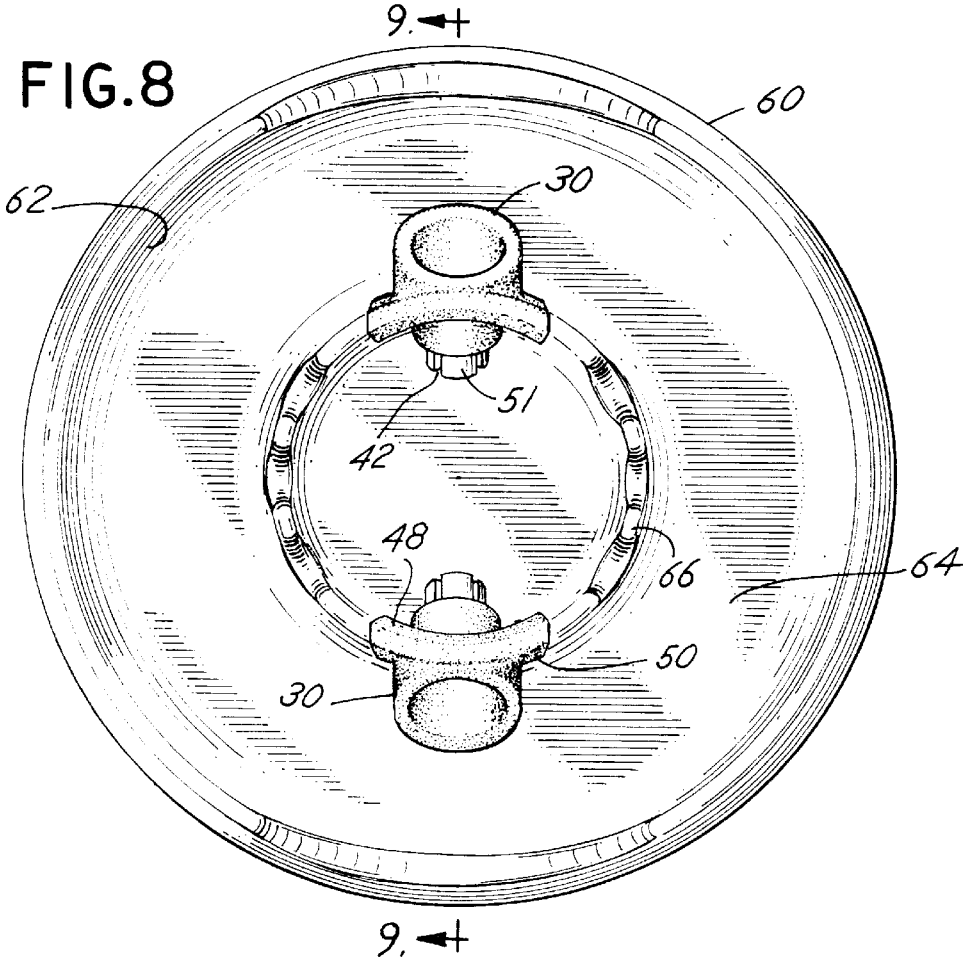
FIG. 8 is a top plan view of the ashtray of FIG. 7.
Figure 9:
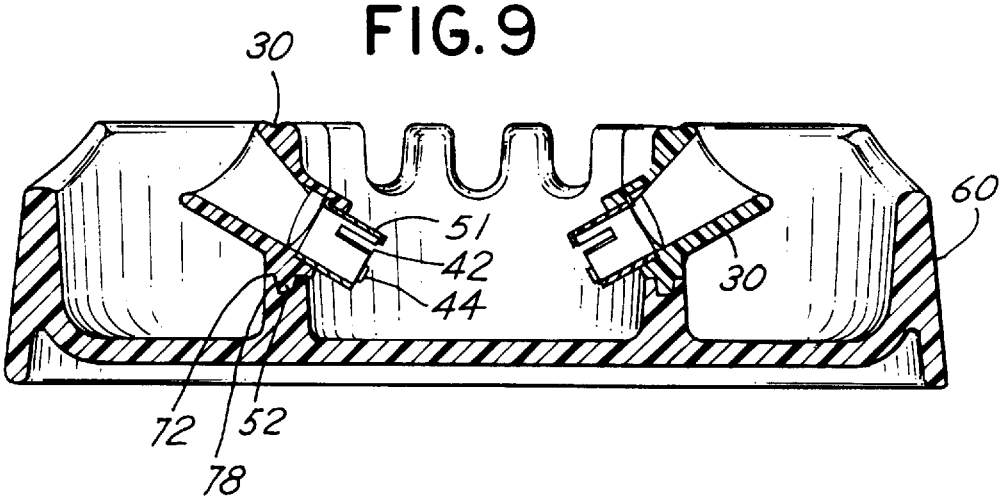
FIG. 9 is a sectional view of the ashtray of FIG. 8 taken along the line 9—9.
Figure 10:
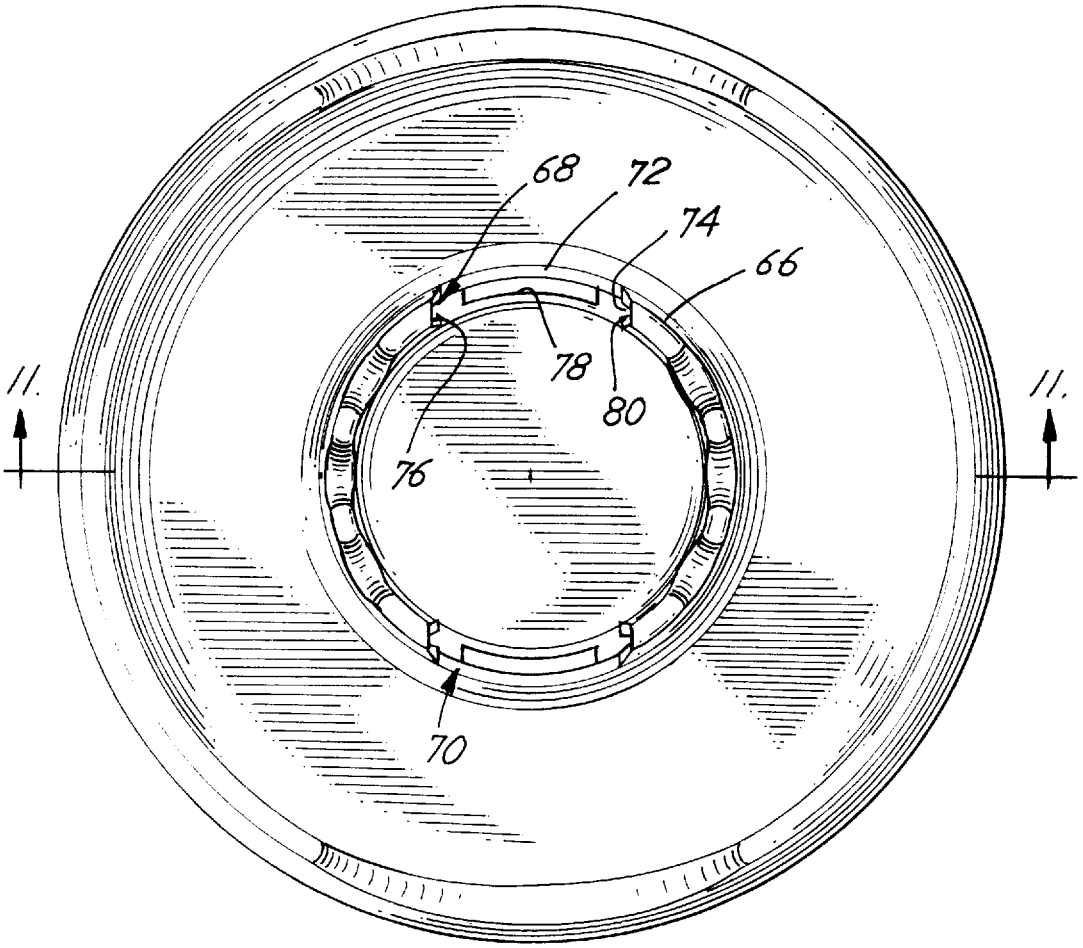
FIG. 10 is a top plan view of the ashtray of FIG. 8 without holders inserted therein.

Referring to FIGS. 4,5 and 6, the holder 30 has a modified construction wherein it is comprised of various composite materials and, in particular, a molded plastic body 31 and a metal sleeve 51 which, when fitted together, comprise a total holder 30. Thus referring to FIG. 4, a holder 30 includes a frustoconical inlet section 38 with an inlet passage 35. The holder 31 further has a center line axis 40. A flange 46 of the type previously described is molded with the holder 31. Thus a flange 46 is molded with the holder 30. The passage 35 connects to an enlarged passage 45 which is coaxial with axis 40. A groove 47 is defined along one side of the passage 45. The passage 45 defines a land or lip 170. As shown in FIG. 4, a metal, cylindrical sleeve 51 is inserted into the holder body 31. The sleeve 51 includes a locking tab 53 which fits into the groove 47. The internal diameter of the sleeve 51 is designed so that the land 70 will provide a smooth transition for a passage 55 of sleeve 51 to the passage 35 of the frustoconical section 38. One or more slots 42 extend radially through the sleeve 51. Inwardly depending tabs or lugs 44 are defined about the periphery of the sleeve 51. Note that in the embodiment depicted, the slots 42 are spaced at 120° distance about the circumference of the sleeve 51 and intermediate each of the slots 42 are lugs 44. Preferably, sleeve 51 is made of metal or metal alloys, such as brass or stainless steel. Alternatively, sleeve 51 may be made of any other material capable of withstanding high heat from a burning cigarette. Deterioration of the sleeve material does not result with such a construction as it may when the entire holder 30 is fabricated from a plastic material affected by heat.

The construction of the slots 42 as described provide that the slots 42 are entirely through the sleeve 51 or through whatever material is used to form the sleeve 51. The slots 42 are parallel to the axes, such as axis 40. However, various other shapes and configurations of slots 57 may be utilized. Also, one or more slots 42 may be utilized. The slots 42 may be curved, angled or otherwise configured about the circumference of the sleeve 51 or such other construction which is analogous to the sleeve 51. The slots 42 may also be replaced by a series of holes such as circular or elliptical holes or other shapes through the sleeve 51 or its analogous component. Thus the slots 42 need not be parallel to the axis as described. Rather the slots define a means for limiting the access of oxygen to the yet unburned cigarette material. Note also that the lugs such as lugs 44 in FIG 4, through 6 are designed to engage the unburned paper which holds tobacco material and thereby preclude further insertion of a cigarette into a sleeve such as sleeve 51. The lugs 44 thus serve the function of maintaining the unburned material of the cigarette within the sleeve in a controlled combustion environment. They constitute a means for limiting the insertion of the cigarette beyond a certain limit; namely, beyond the position of engagement of the paper covering the cigarette. In other words, the unburned portion of the cigarette remains within the sleeve.

It is to be noted that the flange 46 as described in the preferred embodiments above may be omitted and is not necessary to practice the invention. It is also to be noted that the configuration of the flange 46 associated with the holder 30 or any other embodiment for the holder is not a limiting feature of the invention. A flange 46 having three sides is described. However, other flanges, for example, having an arcuate shape or merely having a depending series of radial pins may be utilized in order to practice the invention. Thus the word "flange" should be interpreted so as to encompass not only a circumferential rib or projection from the holder 30 but any other type of item which will retain and hold the cigarette holder in combination with other ashtrays and smoking material holders in general.

TABLE TOP ASHTRAY

Figure 2:
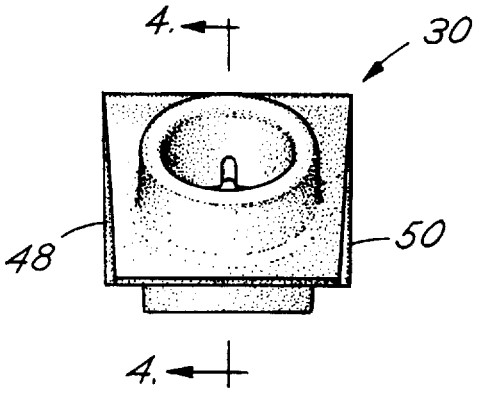
FIG. 2 is a front elevation of the holder of FIG. 1.
Figure 3:
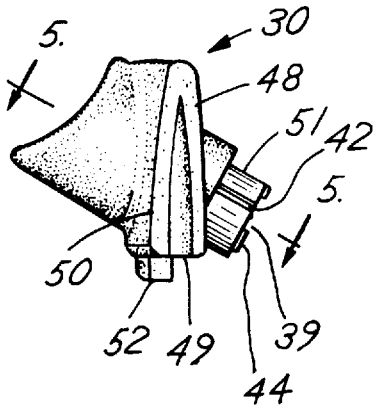
FIG. 3 is a side elevation of the holder of FIG. 2.

FIGS. 7–11 depict a table top ashtray 60 which incorporates the holder 30 of FIG. 1 through 6. That is, the holders 30 of FIGS. 1–6 are incorporated with and placed or inserted into the table top ashtray 60 depicted in FIGS. 7–11. A holder 30, thus is combined with a table top ashtray 60. The table top ashtray 60 has a peripheral or circular, generally vertically upstanding rim 62, which is molded integrally into a bottom 64. A second concentric internal rim 66 is also molded into the bottom 64 as depicted in FIGS. 7–11. First and second slots 68 and 70 are defined on opposite sides of the rim 66. The slots 68 and 70 include a bottom edge 72 and opposed side edges 74 and 76. The bottom edge 72 includes an arcuate depression or slot 78 which is adapted to receive the lug 52 projecting from the holder 30. The side edges 74 and 76 are appropriately spaced and sized so as to slidably receive and coactively engage with the side edges 48 and 50 of the holder 30, as shown in FIG. 1 through 3. Thus, rib 49 engages in a slot 80 defined in the rim 66. The holder thus may be snap fitted into the ashtray.

Figure 11:
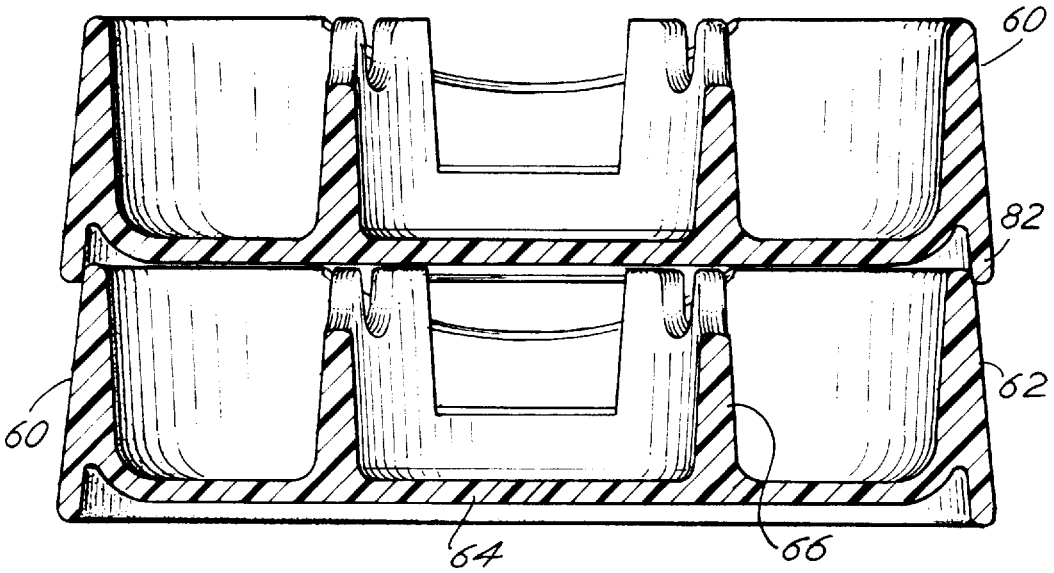
FIG. 11 is a cross sectional view of two stacked ashtrays of the type generally depicted in FIG. 10 taken along the line 11—11.
Figure 12:
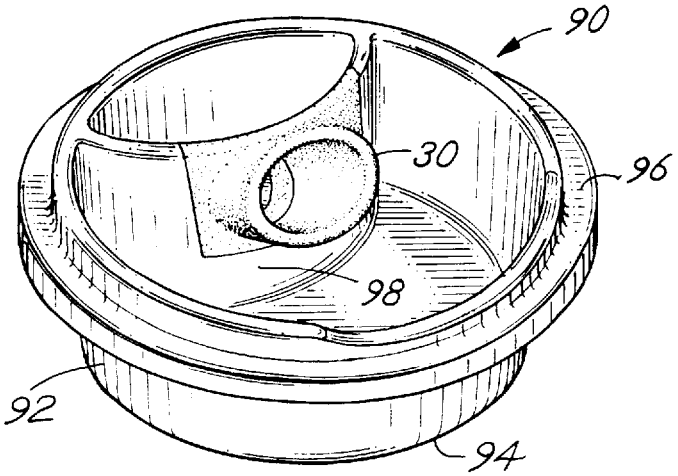
FIG. 12 is a perspective view of an alternative embodiment of the invention wherein a holder is incorporated in an ashtray adapted to be cooperative with an automobile cup holder for example.
Figure 13:
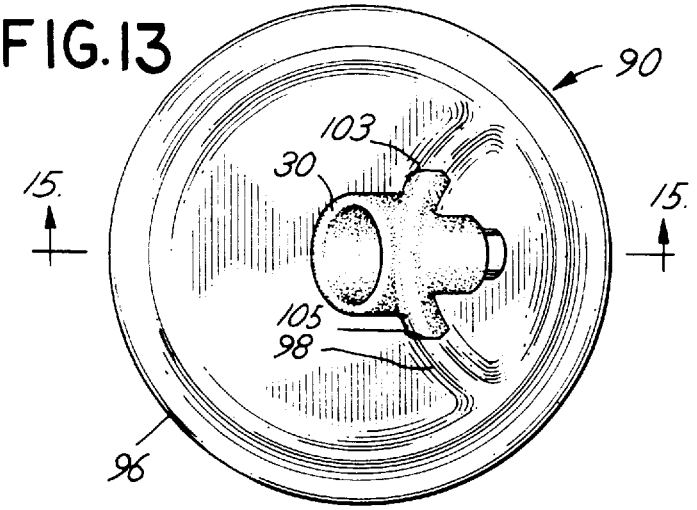
FIG. 13 is a top plan view of the ashtray of FIG. 12.
Figure 14:
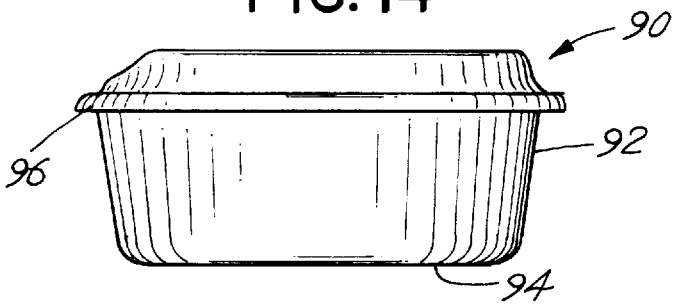
FIG. 14 is an elevation of the ashtray of FIG. 12.

It will be noted by reference to FIG. 11 that the bottom 64 is molded integrally with the rims 62 and 66, and that the rims 62 and 66 are concentric with the generally circular bottom 64. The outer rim 62 includes a depending outwardly canted lip 82 permitting ashtrays 60 of the design of FIGS. 7–11 to be stacked one upon the other with the lip 82 retaining the ashtrays 60 as shown in FIG. 11 for purposes of storage.

The particular circular configuration of the table top ashtray 60 is by way of example. Many other geometrical shapes may be utilized. Integrating the holder 30 with such other geometrical shapes can be accomplished by providing a slot such as the slots 68 and 70 in such other ashtray configurations for compatible reception of the holder 30.

CUP HOLDER ASHTRAY

Figure 15:
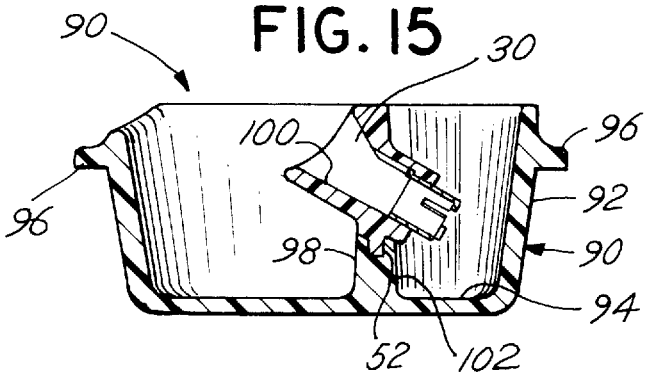
FIG. 15 is a side cross section view of the ashtray of FIG. 11 taken along the line 15—15.
Figure 16:
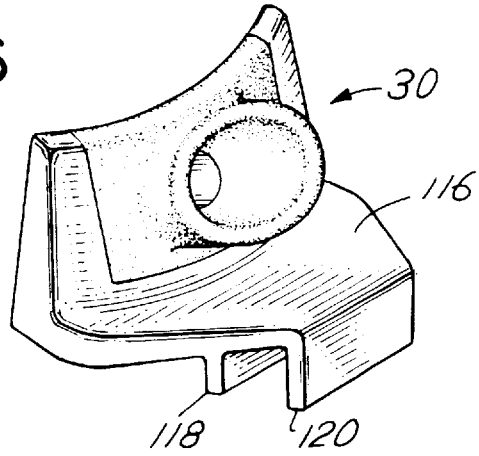
FIG. 16 is a perspective view of another embodiment of the invention wherein a holder is incorporated in combination with a supporting tray that is useful in combination with an automobile ashtray, for example.
Figure 17:
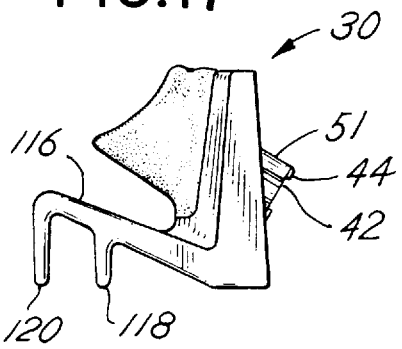
FIG. 17 is a side elevation of the device of FIG. 16.
Figure 18:
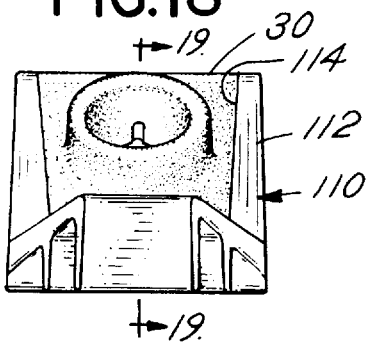
FIG. 18 is a front elevation of the device of FIG. 16.
Figure 19:
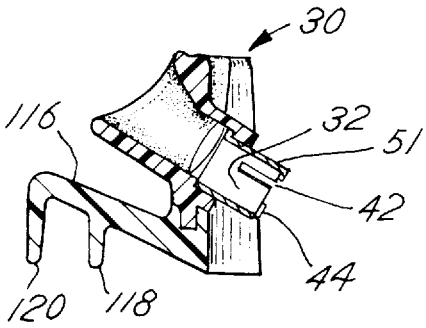
FIG. 19 is a sectional view along the line 19—19 of the device of FIG. 18.
Figure 20:
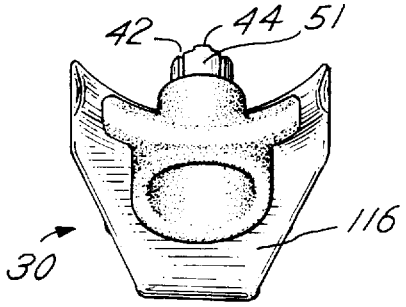
FIG. 20 is a top plan view of the device of FIG. 16 and FIG. 18.

FIGS. 12–15 depict yet another embodiment of the invention. Referring to those figures, a cup holder ashtray 90 includes a generally circular outer wall 92 which is integrally molded with a bottom wall 94. Wall 92 may be of decreasing diameter to accommodate various sizes of cup holders. A radially outwardly extending rim 96 is defined on the outside surface of the wall 92. Within the region defined by the circular wall 92 on the inside of the ashtray 90 is a cross wall 98 defining, in general, a chord of the wall 92. The wall 98 includes a slot 100 which is configured in the manner of the slots 68 and 70 depicted with respect to the table top ashtray of FIGS. 7–11. The slot 100 compatibly receives a holder 30, as depicted in FIG. 15, for example. The depending lug 52 thus engages a recess or slot 102. The side edges 48 and 50 of the holder 30, coact with the side edges 103, 105 of the slot 100 again in the manner described for the table top ashtray 60. The diameter of the embodiment of FIGS. 12–15 is determined by a cup holder, for example, a cup holder incorporated in a motor vehicle. In this manner, the ashtray 90 of FIGS. 12–15 may be slidably inserted into a cup holder and retained from passing therethrough by the circular rim 96. The rim 96 may be canted or arranged at an angle relative to the vertical side walls 92 so as to appropriately position the ashtray 90 in the cup holder. Thus, as depicted in FIG. 15, the rim 96 extends vertically above the bottom wall 94, a lesser distance on one side of the ashtray 90 than on the other side. Also, the side walls may be angled rather than perpendicular to bottom wall 94. Again, various other configurations of the ashtray 90 may be provided and combined with holder 30, as described.

ASHTRAY ARM

FIGS. 16–20 illustrate yet a further combination of the holder element 30 with other elements to provide a cigarette holder device. Specifically, a molded support arm or member 110 includes a vertical support wall 112. Wall 112 includes a slot 114 adapted to receive the holder 30. Again slot 114 is configured so as to be compatible with the holder 30 as previously described. An inclined lateral wall or arm 116 projects from the vertical wall 112 and is integrally molded therewith. The wall 116 includes downwardly depending spaced gripping walls 118 and 120 which are fabricated to fit over a lip or ledge of an ashtray, for example, an automobile ashtray to hold the entire assembly in position over the ash receptacle of such an ashtray.

Again, a single holder 30 is shown in combination with a single arm 116 having a described configuration set forth in the drawing. However, other configurations are appropriately combinable with such a holder 30.

With the invention, one of the important features is the construction of the shape and size and relative length of the slots 42. In defining the configuration and size of the slots 42, it has been found that the lugs 44 hold a cigarette in place within the cylindrical section 32 and that the length of the cylindrical section 32 is adequate to accommodate the portion of the cigarette often referred as the "coal". Oxygen is necessary for the coal to continue to burn unassisted. Tests disclose that in the event the slots 42 are sized to provide complete coverage of the coal, the coal will become extinguished in due course. However, the shortest extinguishment time was determined to be associated with a coverage of about 30–36% of the coal surface area. Longer extinguishment times were determined to be associated with surface area of the coal coverage in the range of 40% and greater, although when there is no coverage of the coal, there is a long extinguishment time.

In any event, the use of three longitudinal slots 42 arranged parallel to one another, separated by approximately 120°, passing through the cylindrical section 36 and parallel to the axis 40 from the inner end 34 for a distance of approximately 5/32" is found to be the most optimal size and configuration for the slots 42. Surface area coverage in such a circumstance of the coal is approximately 45% of the circumference of the cylindrical section 36. Experiments have shown that the particular material which is used to fabricate the holder 30 is not as critical as the accessability of oxygen through slots 42 to the coal. Thus, the material should be non-combustible and resistant to heat.

The cylindrical section 36 should preferably fit snugly against the cigarette inserted therein so as to limit the surface area exposed to the air atmosphere to that which is fitted within the slots 42. It is possible, however, to alter or adjust the pattern of the slots 42. Important features of the invention are the surface area of the coal that will be exposed to the atmosphere or oxygen and as stated herein, approximately 45 ±5% of the circumference of the coal should be exposed to air or oxygen in order to have a highly efficient holder 30 which will reduce the amount of smoke significantly while at the same time permitting the cigarette to continue to burn for a reasonable amount of time of (approximately 100 to 110 seconds). Also, it is to be noted that holders 30, may be integral with ash trays of various design and thus not separable as depicted in FIGS. 1–6. Thus, while various alterations and permutations of the invention are possible, the invention is to be limited only by the following claims and equivalents.

What is claimed is:

1. A cigarette holder for controlling the burn rate of a lighted cigarette, comprising, in combination:

a holder body having a cigarette support with a generally cylindrical through passage of a diameter generally equal to or slightly greater than the diameter of a cigarette, said through passage including a center line axis and shaped to hold a cigarette having a longitudinal axis in the through passage with the cigarette longitudinal axis parallel to the center line axis of the through passage, said cigarette support further including at least one side opening through the support, said cigarette support further including at least one stop member projecting radially inwardly into the through passage toward the center line axis to limit the amount of insertion of a cigarette into the through passage, said side opening sized to fit over a burning portion of a lighted cigarette to diminish the rate of combustion and simultaneously suppress the smoke from the lighted cigarette inserted into the through passage and restrained from passing therethrough by the stop member while at the the same time permitting the cigarette to continue to burn for more than a few seconds at a diminished rate and smoke from the cigarette is suppressed, said side opening further sized to extinguish the lighted cigarette after a defined period greater than a few seconds.

2. The holder of claim 1 wherein the holder body further includes an entry member with a funnel-shaped opening leading into the through passage to guide the lighted end of a cigarette into the passage.

3. The holder of claim 2 wherein the funnel shaped opening has a generally elliptical cross section.

4. The holder of claim 1 wherein the opening through the cigarette support comprises at least one slit, each slit extending longitudinally parallel to the center line axis.

5. The holder of claim 4 wherein a slit is positioned through the body section at a position other than vertically over the center line axis.

6. The holder of claim 1 wherein the through passage has an outer end and inner end and the stop member is a lug at the inner end.

7. The holder of claim 1 wherein the holder further includes a support flange attached to the holder body, said flange attached to the holder body and defining an acute angle therewith.

8. The holder of claim 7 further including a supporting tray for the holder, said holder having said flange including a lower edge and opposite side edges, said edges surrounding the cylindrical through passage, said tray including an open slot for receiving at least the side edges of the flange for supporting the holder in combination with the supporting tray.

9. The holder of claim 8 wherein the tray includes a bottom with an upstanding rim projecting from the bottom, said rim including the open slot for the holder.

10. The holder of claim 9 wherein the tray includes a bottom with a flat support surface for supporting the tray.

11. The holder of claim 8 wherein the tray is in the shape of a dish with a bottom and a peripheral rim with at least one open slot in the rim for the holder.

12. The holder of claim 8 wherein the tray is in the shape of a dish with a bottom a peripheral rim and a rib within the dish projecting from the bottom and including an open slot for the holder.

13. The holder of claim 8 wherein the supporting tray includes a support arm projecting from a rim, said slot positioned in the rim for receipt of the holder and said arm including means for attaching the arm to a separate support stand.

14. A cigarette holder which initially suppresses slip or side stream smoke and subsequently quenches a burning cigarette positioned in the holder, said holder comprising in combination:

a holder body with a cylindrical throughbore and an inlet to the throughbore for guidance of a lighted cigarette into the throughbore, said throughbore having a center line axis, said throughbore including at least one radially directed opening from the cylindrical through bore to the atmosphere, said throughbore congruently sized and shaped to receive the uncombusted cigarette and including an inside end with at least one inwardly depending lug to retain the cigarette, said radially directed opening sized to fit over a burning portion of a lighted cigarette positioned in the throughbore to diminish the rate of combustion and simultaneously suppress smoke while at the same time permitting the cigarette to continue to burn for more than a few seconds and to extinguish the lighted cigarette after a defined period greater than a few seconds.

15. The holder of claim 14 wherein the holder body further includes a support flange surrounding at least in part the holder body, said flange including means for attaching the holder to an ashtray or other cigarette ash and collection device.

16. The holder of claim 15 wherein the flange supports the holder body in an orientation relative to horizontal in the range of 0° to 90°.

17. The holder of claim 14 wherein the opening extends from the lugs toward the funnel shaped opening to the through bore and comprises in the range of about 0% to 60% of the internal surface area of the through bore.

18. The holder of claim 14 wherein the opening comprises at least one slit parallel to the center line axis of the through bore.

19. The holder of claim 18 wherein the opening comprises at least two equally spaced slits parallel to the center line axis of the through bore.

20. The holder of claim 14 wherein the holder body is comprised of a sleeve forming the through bore, said sleeve attached at one end to a molded funnel shaped inlet.

21. The holder of claim 20 wherein the sleeve is made from material capable of withstanding high heat from a burning cigarette.

22. The holder of claim 21 wherein the sleeve is made from high temperature plastic.

23. The holder of claim 20 wherein the sleeve is made from metal or metal alloy.

24. The holder of claim 20 wherein the sleeve is made from brass or stainless steel.

25. The holder of claim 20 wherein the sleeve includes an inner end and an outer end, said outer end including a locking tab for connection to the funnel shaped inlet.

* * * * *